United States Patent [19]

Harada et al.

[11] 4,283,368

[45] Aug. 11, 1981

[54] RADIAL FLOW CATALYTIC CONVERTER

[75] Inventors: Setsuo Harada; Katsuhiko Yokooku, both of Hiroshima, Japan

[73] Assignee: Toyo Kogyo Co., Ltd., Hiroshima, Japan

[21] Appl. No.: 52,917

[22] Filed: Jun. 26, 1979

[30] Foreign Application Priority Data

Jun. 27, 1978 [JP] Japan ..... 53/88978[U]
Aug. 16, 1978 [JP] Japan ..... 53/112680[U]

[51] Int. Cl.[3] ..... B01J 8/02; F01N 3/28
[52] U.S. Cl. ..... 422/181; 60/299
[58] Field of Search ..... 422/181; 60/299, 302; 29/157 R, 455 R, 163.5 F

[56] References Cited

U.S. PATENT DOCUMENTS

| | | | |
|---|---|---|---|
| 3,649,214 | 3/1972 | Henriksson et al. | 422/181 |
| 3,751,917 | 8/1973 | Garcea | 422/181 |
| 3,947,545 | 3/1976 | Ishida et al. | 60/299 |
| 3,950,139 | 4/1976 | Cannon | 60/299 |
| 4,083,694 | 4/1978 | Takeda et al. | 60/299 |
| 4,087,966 | 5/1978 | Akado et al. | 60/302 |
| 4,124,357 | 11/1978 | Akimoto et al. | 422/181 |
| 4,151,717 | 5/1979 | Katsumoto et al. | 60/302 |

*Primary Examiner*—Bradley Garris
*Attorney, Agent, or Firm*—Wenderoth, Lind & Ponack

[57] ABSTRACT

A catalytic converter includes a double-walled enclosure including inner and outer shells one positioned inside the other to define an annular adiabatic space therebetween, a perforated outer sleeve positioned inside the double walled enclosure with an outer chamber defined between it and the inner shell, and a perforated inner sleeve positioned inside the perforated outer sleeve with an annular intermediate chamber defined between it and the perforated outer sleeve while defining an inner chamber at the inside thereof. The annular intermediate chamber is used to contain a bed of catalyst material. The inner shell is constituted by first and second generally cylindrical shell sections while the outer shell is constituted by first and second longitudinal sections each being of a generally semicircular cross section.

7 Claims, 7 Drawing Figures

RADIAL FLOW CATALYTIC CONVERTER

BACKGROUND OF THE INVENTION

The present invention generally relates to an automobile exhaust gas purifying device and, more particularly, to a casing structure for a catalytic converter of the radial flow type.

Various types of radial-flow catalytic converters for substantially purifying exhaust gases emitted from an automobile combustion engine are well known to those skilled in the art and are currently commercially installed in automobile exhaust systems, an example of which is schematically shown in FIG. 1 of the accompanying drawings in longitudinal sectional view. Referring first to FIG. 1, the illustrated prior art catalytic converter 10 is shown as disposed between an outlet of the exhaust manifold 11 and an exhaust pipe 12 and located in the vicinity of and laterally of the automobile internal combustion engine E with its longitudinal axis oriented vertically. The catalytic converter 10 comprises a generally cylindrical double-walled enclosure 13 having an annular container 14 coaxially positioned inside the double-walled enclosure 13. The annular container 14 is for accommodating therein a catalyst material M and is comprised of a cylindrical perforated inner sleeve 15 and a cylindrical perforated outer sleeve 16. These inner and outer sleeves 15 and 16 have their respective first ends closed by a common end plate 17 and their respective second ends welded to the inner and outer peripheral faces of an annular flange member 18 adapted to be connected to a mating flange 11*a* of the exhaust pipe 11.

The double-walled enclosure 13 having the annular container 14 disposed therein in coaxial relation thereto has its first end rigidly connected to an annular flange member 19 adapted to be connected to a mating flange 12*a* of the exhaust pipe 12 and its second end welded to the outer peripheral face of the annular flange member 18 together with the second end of the outer sleeve 16.

The catalytic converter of the construction shown in FIG. 1 is so designed that exhaust gases of relatively high temperature emitted from the automobile internal combustion engine E and supplied to the converter through the exhaust manifold 11 can flow into the inner chamber inside the perforated inner sleeve 15 and then into a generally annular chamber outside the perforated outer sleeve 16 and inside the double-walled enclosure 13 after having passed through the bed of the catalyst material M contained in the annular intermediate chamber between the perforated inner and outer sleeves 15 and 16, the exhaust gases within the annular chamber outside the perforated outer sleeve 16 and inside the double-walled enclosure 13 being subsequently discharged to the atmosphere as substantially purified exhaust gases.

U.S. Pat. No. 4,124,357 discloses a catalytic converter casing utilizing a generally cylindrical double-walled enclosure which is comprised of generally cylindrical outer and inner shells with an annular space defined therebetween, each of said outer and inner shells of the double-walled enclosure being constituted by a pair of substantially semicircular-cross-section shell halves. Each semicircular-cross-section shell half has a pair of opposed side flanges extending lengthwise thereof and transversely protruding in opposite directions to each other. This double-walled enclosure is, in the assembled condition, of such a construction that the respective pairs of the side flanges of the inner shell halves are connected to each other and extend radially outwardly of the cylindrical inner shell in the opposite directions with respect to each other thereby dividing the annular space into two semicylindrical space sections, said respective pairs of the side flanges of the inner shell halves being in turn sandwiched firmly between the corresponding pairs of the side flanges of the outer shell halves which are connected to each other to form the cylindrical outer shell.

Since the catalytic converter for automobile use is generally operated under a condition not only of elevated temperature, but also vibrations which may be generated by the combustion engine being operated and/or by the running of an automobile on an irregular road surface, the direction in which a particular physical force, which may bring about damage to the catalytic converter casing, acts on the catalytic converter casing is not fixed. By way of example, as is well known to those skilled in the art, during the operation of the internal combustion engine, not only does the engine vibrate as a result of a movement of the crankshaft, but also it tends to undergo a rolling motion when the power torque of the engine varies as a result of the foot-controlled adjustment of the acceleration pedal. In addition, the engine vibrates as the vehicle runs on an irregular road. In view of this, the catalytic converter is required to be durable so as to withstand the complex vibrations which may be transmitted from the engine proper and also from the vehicle superstructure to the catalytic converter.

Where the catalytic converter is mounted in the vicinity of the combustion engine with the inlet port of the catalytic converter coupled directly to the outlet port of the exhaust manifold such as shown in FIG. 1, some of the various welded joints employed in any one of the prior art catalytic converters tend to be adversely affected by the complex vibration of the engine. In particular, where the catalytic converter is supported by the exhaust manifold, fixed to the engine proper, and by the exhaust pipe, fixed to the vehicle superstructure, at a position laterally of the engine proper with its longitudinal axis oriented vertically, there is the possibility that, as the engine undergoes the rolling motion, one end portion of the catalytic converter adjacent the engine proper tends to be pulled outwardly relative to the opposite end portion thereof. Moreover, there is also a possibility that the catalytic converter will undergo a substantial pivotal or swivel motion about the point of connection of the catalytic converter to the exhaust manifold. The worst that may happen is the possible detachment of the catalytic converter from the exhaust manifold, and also a possible breakage of the converter casing which may in turn bring about a possible breakage of the annular container inside the double-walled enclosure.

SUMMARY OF THE INVENTION

Accordingly, the present invention has been made with a view to substantially eliminating the above described disadvantages and inconveniences inherent in the prior art catalytic converters and has for its essential object to provide an improved catalytic converter having the double-walled enclosure having a physical strengh sufficient to withstand undesirable forces acting thereon in a direction axially of the catalytic converter and also in a direction transversely and radially inwardly of the catalytic converter.

Another important object of the present invention is to provide an improved catalytic converter of the type referred to above, which can readily be manufactured with a minimum number of component parts and without requiring any complicated skill.

In order to accomplish these and other objects of the present invention, there is provided an improved catalytic converter wherein the inner and outer shells forming the double-walled enclosure are each constituted by a pair of shell halves. The shell halves of the inner shell are connected in end-to-end relation to each other whereas the shell halves of the outer shell each having a substantially semicircular cross section are connected in side-by-side relation to each other. Therefore, in the present invention, since the joint between the shell halves of the inner shell and the joints between the shell halves of the outer shell extend circumferentially and axially of the double-walled enclosure, respectively, the inner and outer shells forming the double-walled enclosure advantageously cooperate with each other in such a manner as to make the double-walled enclosure as a whole resistive to the undesirable forces which may, when the catalytic converter according to the present invention is in use, act thereon in respective directions generally parallel to and generally perpendicular to the longitudinal axis of the catalytic converter.

Moreover, according to the present invention, the annular flange member, positioned in opposed relation to the common end plate and defining the annular intermediate chamber in cooperation with the perforated inner and outer sleeves and the common end plate, has one or more openings through which the catalyst material is charged into the annular intermediate chamber. This or these openings in the annular flange member are, after the catalyst material has been charged into the annular intermediate chamber, closed by an annular gasket member interposed between such annular flange member and the mating flange of the exhaust manifold leading from the internal combustion engine when the catalytic converter according to the present invention is installed on a vehicle. This arrangement is advantageous in that no plug member such as has heretofore been required to close the catalyst inlet openings is required in the present invention.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Figure 1:
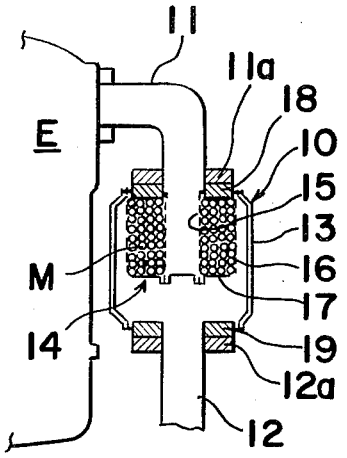
Fig. 1 Prior Art
FIG. 1 is a schematic longitudinal sectional view of the prior art catalytic converter mounted in an automobile internal combustion engine.

Before the description of the present invention proceeds, it is to be noted that like parts are designated by like reference numerals throughout the accompanying drawings.

Figure 2:
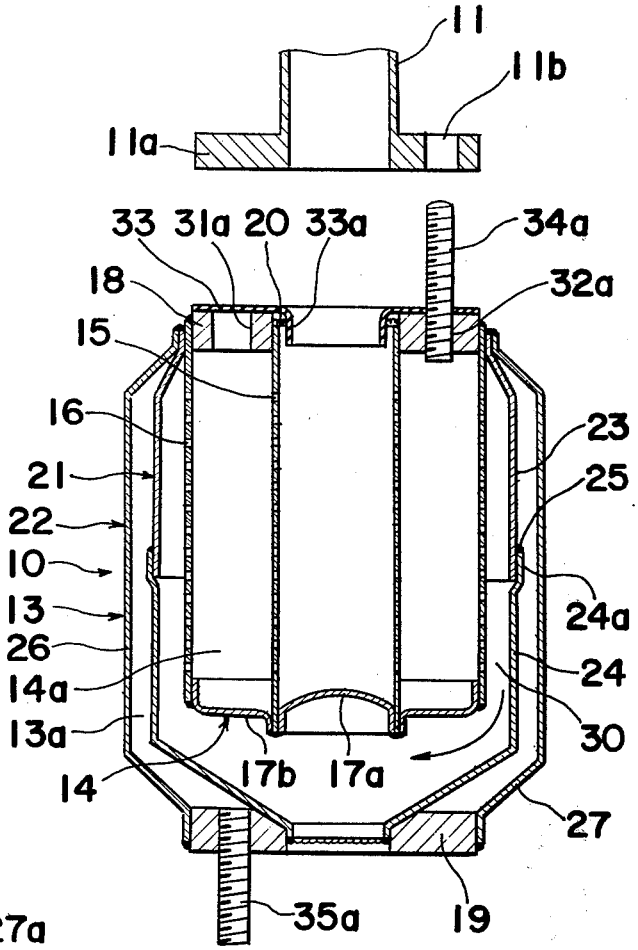
FIG. 2 is a longitudinal sectional view of a catalytic converter according to a preferred embodiment of the present invention.
Figure 3:
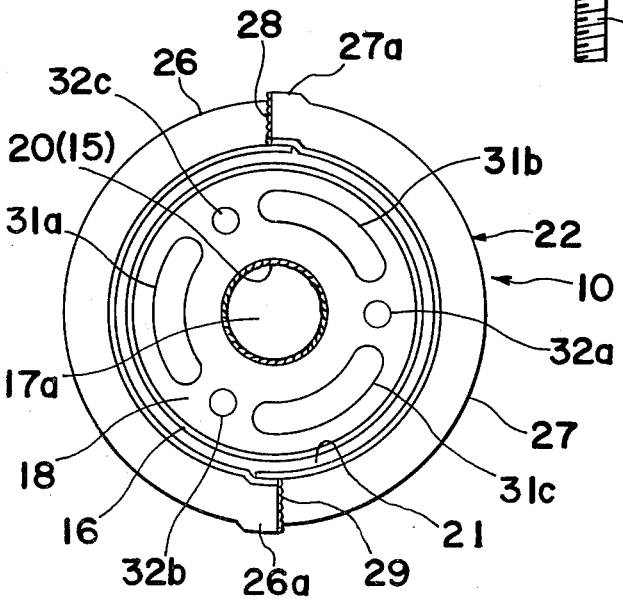
FIG. 3 is a end view of the catalytic converter shown in FIG. 2.
Figure 4:
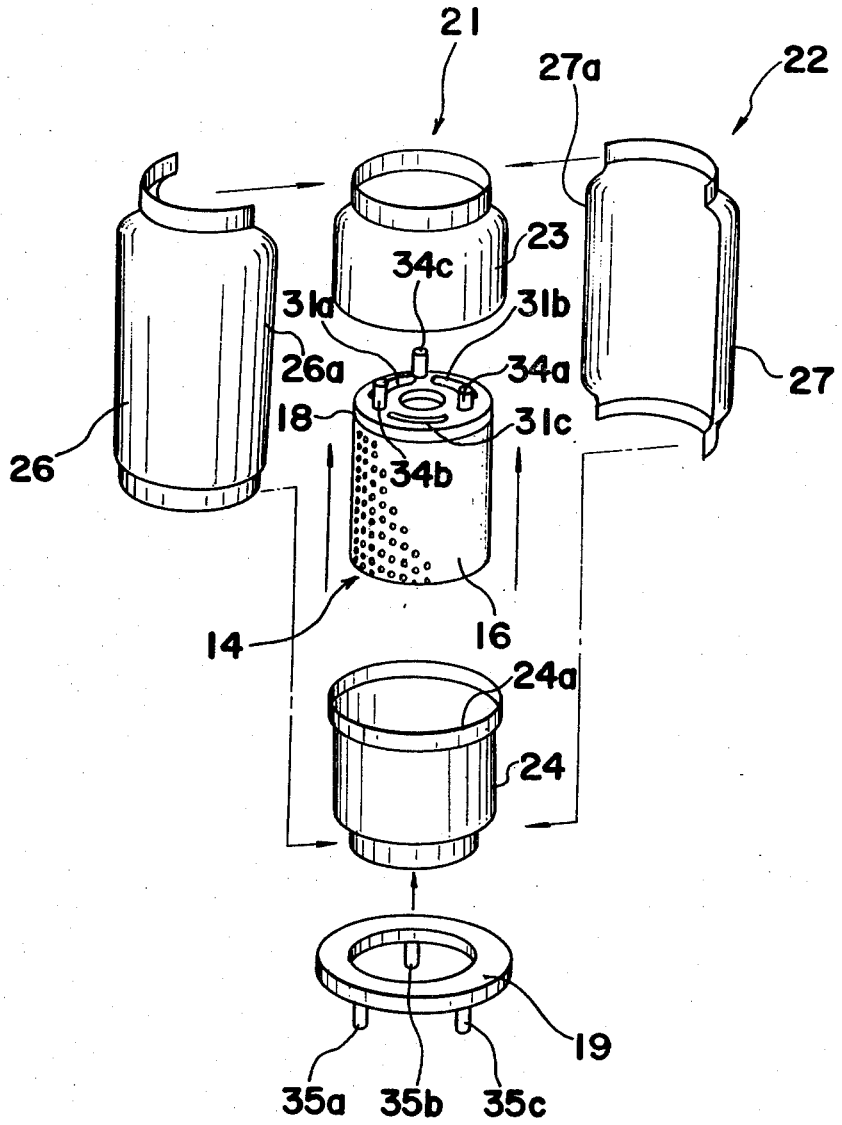
FIG. 4 is an exploded perspective view of the catalytic converter shown in FIG. 2.

Referring now to FIGS. 2 to 4, a catalytic converter, generally identified by 10 and embodying the present invention, comprises a generally cylindrical double-walled enclosure 13 having an annular adiabatic space **13*a* defined therein in a manner as will be described later, and an annular perforated container 14 coaxially positioned inside the double-walled enclosure 13 and having an annular intermediate chamber 14*a* which is defined therein in a manner as will be described later and which contains therein an annular bed of any known catalyst material identified by M in FIGS. 1, 5 and 6**.

As best shown in FIG. 2, the annular perforated container 14 is comprised of a cylindrical perforated inner sleeve 15 and a cylindrical perforated outer sleeve 16 of a diameter sufficiently larger than that of the inner sleeve 15 as to enable the annular intermediate chamber **14*a* to be defined therebetween. The inner sleeve 15 has one end closed by a disc closure 17*a* and has the opposite end welded circumferentially at 20 to the inner peripheral face of an annular flange member 18, whereas one end of the outer sleeve 16 adjacent the closed end of the inner sleeve 15 is closed by an annular end cap 17*b* having its outer peripheral edge welded circumferentially to the closed end of the inner sleeve 15. The opposite end of the outer sleeve 16 is welded circumferentially to the outer peripheral face of the annular flange member 18**.

The disc closure **17*a* used to close the end of the inner sleeve 15 is preferably in the form of a convex disc having its convexity disposed axially inwardly of the inner sleeve 15** so that any possible deformation which would occur as a result of impingement thereon of the exhaust gases under pressure can advantageously be avoided.

The double-walled enclosure 13 is comprised of generally cylindrical inner and outer shells 21 and 22 one positioned inside the other to define the adiabatic space **13*a* therebetween. The inner shell 21 has its opposite end portions inwardly tapered and rigidly secured to, or otherwise welded circumferentially to, the outer peripheral face of the annular flange member 18 and the inner peripheral face of the annular flange member 19, respectively, whereas the outer shell 22 positioned externally of and in coaxial relation to the inner shell 21 has its opposite end portions similarly inwardly tapered and rigidly secured to, or otherwise welded circumferentially to, the outer peripheral face of the annular flange member 18 and the outer peripheral face of the annular flange member 19, respectively. It is to be noted that the respective tapered ends of the inner and outer shells 21 and 22 remote from the annular flange member 19 and adjacent the annular flange member 18 are preferably welded circumferentially to the outer peripheral face of the annular flange member 18 in overlapping relation to each other and also to that end of the perforated outer sheeve 16**.

In accordance with the present invention, each of the inner and outer shells 21 and 22 forming the double-walled enclosure 13 is comprised of two component parts, which will now be described. As best shown in FIGS. 2 and 3, the inner shell 21 is constituted by first and second cylindrical shell sections 23 and 24. The first shell section 23 has one end gently constricted radially inwardly to a diameter corresponding to the outer diameter of the annular flange member 18. On the other hand, the second shell section 24 has one end gently constricted radially inwardly to a diameter corresponding to the inner diameter of the annular flange member 19 and the opposite end enlarged at 24*a* to provide an annular flap, said annular flap 24*a*, when the shell sections 23 and 24 are assembled together to provide the complete inner shell 21 in a manner as best shown in FIG. 2, telescopically tightly receiving therein the opposed end of the first shell section 23.

It is to be noted that after the inner shell 21 has been completely assembled with the first and second shell sections 23 and 24 in the manner described above, the joint between these shell sections 23 and 24 is welded circumferentially at 25.

As best shown in FIGS. 3 and 4, the outer shell 22 is constituted by first and second longitudinal shell sections 26 and 27 each having a semicircular cross section. These first and second longitudinal shell sections 26 and 27 are so designed and so shaped relative to each other that when these sections 26 and 27 are assembled together in a manner as will be described later, a complete outer shell 22 of the required shape is obtained. Specifically, these first and second longitudinal shell sections 26 and 27 have respective longitudinal flaps 26*a* and 27*a* defined at one side edge portion thereof, said longitudinal flaps 26*a* and 27*a* being so designed and so shaped as to overlay the respective opposed side edge portions of the first and second longitudinal shell sections 26 and 27, as best shown in FIG. 3, in the assembled condition of the outer shell 22. The opposite seams, one defined between the longitudinal flap 26*a* of the first longitudinal shell section 26 and the mating side edge portion of the second longitudinal shell section 27 and the other defined between the longitudinal flap 27*a* of the second longitudinal shell section 27 and the mating side edge portion of the first longitudinal shell section 26, are welded as shown by 28 and 29 in FIG. 3 after the outer shell 22 has completely been assembled with the first and second longitudinal shell sections 26 and 27.

From the foregoing, it is clear that the inner shell 21 is comprised of circumferentially divided shell sections 23 and 24 while the outer shell 22 is comprised of axially divided shell sections similar in shape to each other.

The double-walled enclosure 13 of the construction hereinabove described encloses therein the annular perforated container 14 in coaxial relation with an outer chamber 30 defined between the outer sleeve 16 and the inner shell 21.

In the construction so far described, the exhaust gases emitted from the automobile internal combustion engine E and entering the hollow interior of the inner sleeve 15 flow into the bed of the catalyst material M through the perforations in the inner sleeve 15 and, after having passed through the catalyst bed in a direction radially outwardly of the catalyst bed, flow into the outer chamber 30 through the perforations in the outer sleeve 16. The exhaust gases, the noxious components of which have been removed during the passage through the catalyst bed within the annular intermediate chamber 14*a*, are discharged from the outer chamber 30 to the atmosphere through the opening in the annular flange member 19 by way of the exhaust pipe 12 (FIG. 1).

The annular flange member 18 has three equally circumferentially spaced arcuate slots 31*a*, 31*b* and 31*c* and a corresponding number of equally spaced threaded holes 32*a*, 32*b* and 32*c*, all of them extending completely through the thickness of the annular flange member 18. These arcuate slots 31*a* to 31*c* serve as supply ports through which the catalyst material M, which may be in the form of either particles or pellets, is filled into the annular intermediate chamber 14*a* and they are closed by an annular gasket member 33 having a construction which will be described later, said gasket member 33 being held in position between the annular flange member 18 and the mating flange 11*a* of the exhaust manifold 11 when the catalytic converter 10 is installed on the automobile internal combustion engine E. The threaded holes 32*a* to 32*c* have respective anchor bolts 34*a*, 34*b* and 34*c* (FIG. 4) each having one end tightly received in the corresponding threaded hole 32*a*, 32*b* or 32*c* in the annular flange member 18. The opposite ends of the respective anchor bolts 34*a* to 34*c* are adapted to receive corresponding nuts (not shown) after they have extended through corresponding holes defined in the mating flange member 11*a* (only one of said holes being shown by 11*b* in FIG. 2) during the connection of the catalytic converter 10 to the exhaust manifold 11.

The annular gasket member 33 preferably has on its inner peripheral edge an integrally formed cylindrical collar member 33*a* protruding therefrom in a direction axially inwardly of the inner sleeve 15. The cylindrical collar member 33*a* has an outer diameter smaller than the inner diameter of the inner sleeve 15 and has an axial length sufficient to overhang or cover the weld joint 20 within the space defined between the inner peripheral face of the annular flange member 18 and the collar member 33*a*. The use of the annular gasket member 33 having the collar member 33*a* integral therewith is advantageous in substantially eliminating the possibility of undesirable melt-down of the weld material forming the weld joint 20 which could occur due to the contact with the exhaust gases at elevated temperature.

The annular gasket member 33 also has circumferentially equally spaced holes equal in number to the number of the anchor bolts 34*a* to 34*c* through which the anchor bolts 34*a* to 34*c* extend when it is held in position between the annular flange member 18 and the mating flange 11*a*.

As is the case with the annular flange member 18, the annular flange member 19 has three equally spaced threaded holes defined therein and into which anchor bolts 35*a*, 35*b* and 35*c* are tightly threaded. These anchor bolts 35*a* to 35*c* are used to connect the mating flange 12*a* of the exhaust pipe 12 (FIG. 1) to the annular flange member 19 in a manner similar to the anchor bolts 34*a* to 34*c*.

It is to be noted that the number of the arcuate openings need not be limited to three as shown, but may be one or more. In addition, the number of the anchor bolts provided on each of the annular flange members 18 and 19 need not be limited to three, but may be two or more.

It is also to be noted that either or both of the inner and outer sleeves 15 and 16 forming the annular perforated container 14 may be prepared by curling a perforated sheet of metallic material into a cylindrical shape and then welding the opposed edges of the metallic sheets together.

From the foregoing description, it is clear that the double-walled enclosure 13 of the construction hereinbefore described can sufficiently and effectively withstand the external forces acting thereon in directions both parallel to and perpendicular to the longitudinal axis of the catalytic converter 10. In addition, the employment of the circumferentially divided shell sections for the inner shell 21 and the axially divided shell sections for the outer shell 22 is advantageous in that no very complicated welding technique is required to provide a substantially complete seal against any possible leakage of the exhaust gases flowing inside the catalytic converter 10.

In order to make the catalytic converter casing resistive not only to the external force acting thereon in directions both parallel to and perpendicular to the longitudinal axis thereof, but also to any possible deformation which may occur under the influence of vibrations repeatedly transmitted thereto, reinforcement bead means may be provided on at least one of the double-walled enclosure 13, the inner sleeve 15 and the outer sleeve 16, which will now be described with reference to FIGS. 5 to 7.

Figure 5:
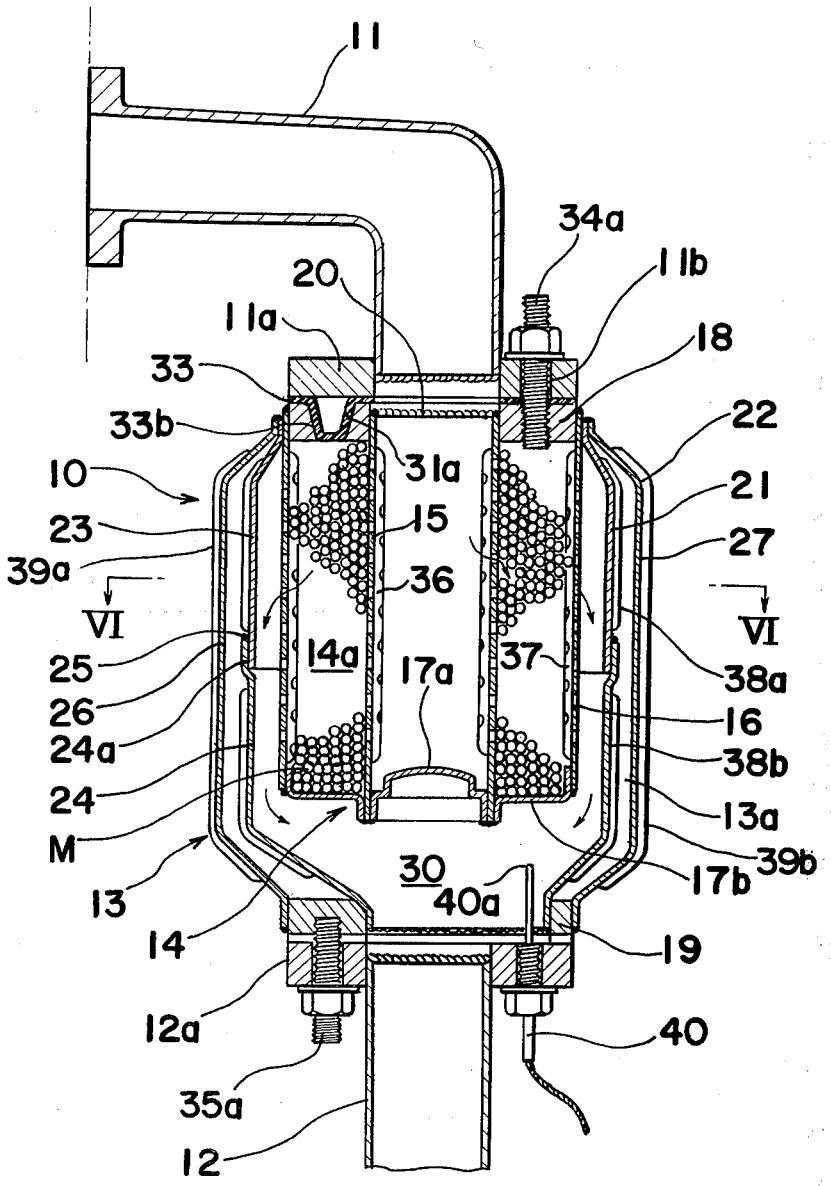
FIG. 5 is a view similar to FIG. 2, showing a catalytic converter according to another preferred embodiment of the present invention.
Figure 6:
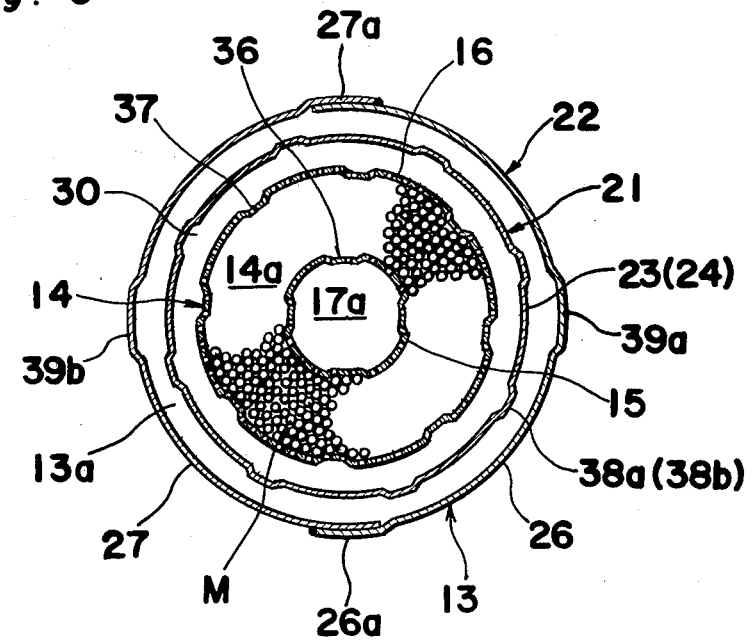
FIG. 6 is a cross sectional view taken along the line VI—VI in FIG. 5.
Figure 7:
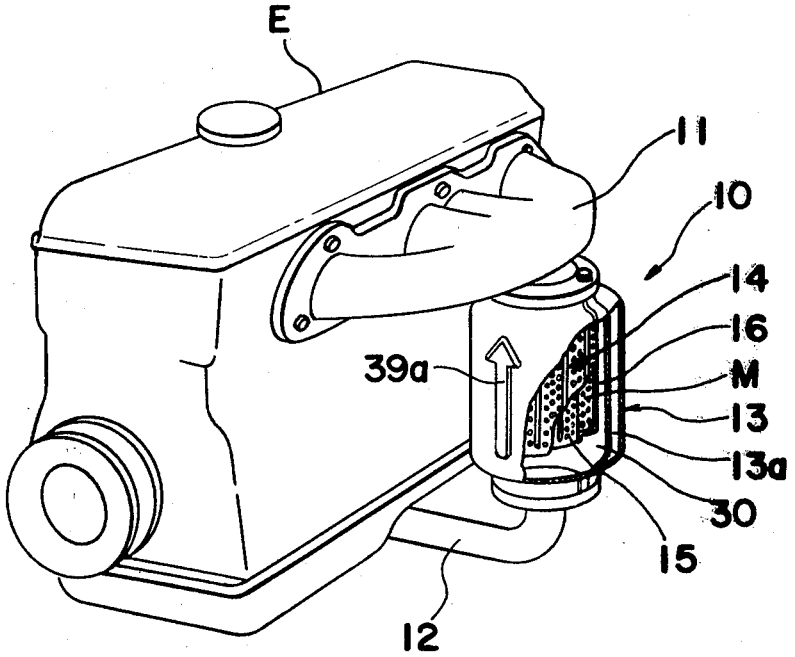
FIG. 7 is a perspective view showing the manner in which the catalytic converter shown in FIG. 5 is mounted on an automobile internal combustion engine.

In the embodiment shown in FIGS. 5 to 7, the reinforcement bead means are shown as being provided on the double-walled enclosure 13, the inner sleeve 15 and the outer sleeve 16. The reinforcement bead means on the inner sleeve 15 comprises one or more, for example, four, beads generally identified by 36, each of said beads being in the form of an elongated indentation extending in a direction parallel to the axis of the inner sleeve 15 and protruding radially inwardly of said inner sleeve 15, the beads 36 being circumferentially equally spaced from each other.

The reinforcement bead means on the outer sleeve 16 comprises one or more, for example, eight, beads generally identified by 37 and circumferentially equally spaced from each other, each of said beads 37 being in the form of an elongated indentation extending in a direction parallel to the axis of the outer sleeve 16 and protruding radially inwardly of said outer sleeve 16.

The reinforcement bead means on each of the first and second cylindrical shell sections 23 and 24 forming the inner shell 21 comprises one or more, for example, eight, beads generally identified by 38*a* or 38*b* and circumferentially equally spaced from each other, each of said beads 38*a* or 38*b* being in the form of an elongated indentation extending in a direction parallel to the axis of the shell section 23 or 24 and protruding radially outwardly of the shell section 23 or 24.

Similarly, the reinforcement bead means on each of the first and second longitudinal shell sections 26 and 27 forming the outer shell 22 comprises at least one bead 39*a* or 39*b* positioned intermediately between the opposed side edges of the corresponding longitudinal shell section 26 or 27, each of said beads 39*a* or 39*b* being in the form of an elongated indentation extending in a direction parallel to the axis of the outer shell 22 and protruding radially outwardly of the outer shell 22.

As best shown in FIG. 7, at least one of the beads 39*a* and 39*b* formed on the respective longitudinal shell sections 26 and 27, for example, the bead 39*a* on the first longitudinal shell section 26, is preferably in the form of an arrow-shaped indentation so that it can provide a visual reference with which one can correctly install the catalytic converter 10 on the engine exhaust system in the proper direction with no possibility of it being positioned upside-down.

The annular gasket member 33 as best shown in FIG. 5 has arcuate indentations 33*b* equal in number to the arcuate slots 31*a*, 31*b* and 31*c* (FIG. 3) in the annular flange member 18 and complementary in shape to the cross-sectional shapes of the corresponding arcuate slots 31*a* to 31*c*. These arcuate indentations 33*b* serve as closure members which are, after the catalyst material M has been charged into the annular intermediate chamber 14*a*, received into the corresponding arcuate slots 31*a* to 31*c* in the annular flange member 18 to close the arcuate slots 31*a* to 31*c*.

The catalytic converter 10 of the construction shown in either FIGS. 2 to 4 or FIGS. 5 to 7 may have a temperature detector for sensing the temperature inside the catalytic converter 10 for the purpose well known to those skilled in the art. This temperature detector may comprise, as shown in FIG. 5, a sensor 40 having a probe 40*a*, said sensor 40 being threaded to the annular flange member 19 with the probe 40*a* positioned inside the chamber 30.

Although the present invention has fully been described in connection with the preferred embodiments thereof with reference to the accompanying drawings, it is to be noted that various changes and modifications will be apparent to those skilled in the art. By way of example, the annular gasket member 33 shown in FIG. 5 may have an axially extending collar member such as shown by 33*a* in FIG. 2. On the other hand, the annular gasket member 33 shown in FIG. 2 may have arcuate indentations such as shown by 33*b* in FIG. 5.

In addition, although the annular perforated container 14 for the catalyst bed has been described and shown as supported at one end on the annular flange member 18, a portion of the container 14 remote from the annular flange member 18 may also be supported by one or both the double-walled enclosure 13 and the annular flange member 19.

Furthermore, the end of the inner shell 21 which has been described as welded to the inner peripheral face of the annular flange member 19 may be welded to the outer peripheral face of the annular flange member 19 together with the adjacent end of the outer shell 22.

The catalytic converter of the present invention is applicable not only to an automobile exhaust system such as referred to in this specification, but also to any other field of industry where exhaust gas purification is required. Moreover, although the annular flange member 18 has been described as being coupled to the exhaust manifold 11 adjacent the engine E, the converter of the present invention can operate satisfactorily and effectively even if the exhaust gases are introduced through the opening in the annular flange member 19 into the chamber 30.

Therefore, these changes and modifications are to be understood as included within the true scope of the present invention unless they depart therefrom.

What is claimed is:

1. A catalyic converter which comprises: an enclosure means having a generally cylindrical shape; a perforated outer sleeve positioned inside the enclosure means with an outer chamber defined between the enclosure means and said perforated outer sleeve; a perforated inner sleeve positioned inside the perforated outer sleeve in coaxial relation thereto and defining an annular intermediate chamber between said perforated outer and inner sleeves and defining an inner chamber within said inner sleeve; a bed of catalyst material in said intermediate chamber; a first port means connected with said inner chamber; and a second port means connected with said outer chamber; said first and second port means respectively being constituted by first and second annular flange members for being connected to a mating flange on a conduit member, said first annular flange member having a central opening defined therein and communicating with said inner chamber, said second annular flange member having a central opening defined therein and communicating with the outer chamber, said first annular flange member further having at least one aperture extending completely through the thickness thereof and opening into said annular intermediate chamber for charging said catalyst material into the annular intermediate chamber through said aperture, said aperture being positioned in said first annular flange for, when said first annular flange and a mating flange are connected, being closed by the mating flange.

2. A catalytic converter as claimed in claim 1, wherein said enclosure means includes inner and outer shells one positioned inside the other to provide an annular adiabatic space therebetween, said inner shell being constituted by first and second generally cylindrical shell sections, said outer shell being constituted by first and second longitudinal sections each having a generally semicircular cross-section, said first and second generally cylindrical shell sections being connected in end-to-end relationship to define said inner shell, said first and second longitudinal shell sections being connected together along edges extending in a direction parallel to the axis of the enclosure to define said outer shell.

3. A catalytic converter as claimed in claim 2, wherein at least one of the inner and outer shells forming the doublewalled enclosure has elongated reinforcement bead means extending in a direction parallel to the longitudinal axis of the converter.

4. A catalytic converter as claimed in claim 3, wherein said at least one of the inner and outer shells is the outer shell and said reinforcement bead means is in the form of a substantially arrow-shaped indentation in the wall forming the outer shell.

5. A catalytic converter as claimed in claim 1, further comprising an annular gasket means having an indentation complementary in shape to the shape of the aperture in the first annular flange member, said annular gasket means being positioned over the first flange member and when the converter is installed, being between said first flange member and a mating flange to which the converter is connected, said indentation in said annular gasket means closing the aperture in the first flange member when said gasket means is so positioned.

6. A catalytic converter as claimed in claim 5, wherein said annular gasket means has a collar member integrally formed therewith and protruding in a direction inwardly of the inner sleeve from the inner peripheral edge of the annular gasket means.

7. A catalytic converter which comprises: an enclosure means having a generally cylindrical shape; said enclosure means including inner and outer shells one positioned inside the other and spaced to provide an annular adiabatic space therebetween, said inner shell being constituted by first and second generally cylindrical shell sections, said outer shell being constituted by first and second longitudinal sections each having a generally semicircular cross-section, said first and second generally cylindrical shell sections being connected in end-to-end relationship to define said inner shell, said first and second longitudinal shell sections being connected together along edges extending in a direction parallel to the axis of the enclosure to define said outer shell, a perforated outer sleeve positioned inside the enclosure means with an outer chamber defined between the enclosure means and said perforated outer sleeve; a perforated inner sleeve positioned inside the perforated outer sleeve in coaxial relation thereto and defining an annular intermediate chamber between said perforated outer and inner sleeves and defining an inner chamber within said inner sleeve; a bed of catalyst material in said intermediate chamber; a first port means connected with said inner chamber; and a second port means connected with said outer chamber; said first and second port means respectively being constituted by first and second annular flange members, said first annular flange member having a central opening defined therein and communicating with said inner chamber, said second annular flange member having a central opening defined therein and communicating with the outer chamber, said first annular flange member further having at least one aperture extending completely through the thickness thereof and opening into said annular intermediate chamber for charging said catalyst material into the annular intermediate chamber through said aperture.

* * * * *